United States Patent [19]

Ligonês

[11] 4,150,532

[45] Apr. 24, 1979

[54] THREAD TYING DEVICE FOR SPINNING FRAME

[75] Inventor: Hubert Ligonês, St. Julien, France

[73] Assignee: Battelle Memorial Institute, Carouge, Switzerland

[21] Appl. No.: 850,385

[22] Filed: Nov. 10, 1977

[30] Foreign Application Priority Data

Nov. 11, 1976 [CH] Switzerland ..... 14210/76

[51] Int. Cl.[2] ..... D01H 15/00; B65H 67/08

[52] U.S. Cl. ..... 57/263; 242/35.5 R

[58] Field of Search ..... 57/58.89–58.95, 57/34 R; 242/35.5 R, 35.5 A, 35.6 R, 35.6 E, 18 A

[56] References Cited

U.S. PATENT DOCUMENTS

| | | | |
|---|---|---|---|
| 3,561,688 | 2/1971 | Hagihara | 242/18 A |
| 3,911,658 | 10/1975 | Smith | 57/34 R |
| 3,945,183 | 3/1976 | Landwehrkamp et al. | 57/34 R |
| 3,962,855 | 6/1976 | Stahlecker | 57/34 R |
| 4,006,864 | 2/1977 | Tooka | 242/35.5 R |
| 4,031,691 | 6/1977 | Roehrich | 57/34 R |

*Primary Examiner*—John Petrakes
*Attorney, Agent, or Firm*—Karl F. Ross

[57] ABSTRACT

A thread-tying device for a spinning frame has a yarn locating head which locates the broken end of the yarn on the spool and is connected by a transmission which transmits the movement of the drive shaft to the disengaged spool. The broken end of the yarn is recovered and retained while the transfer mechanism conveys the yarn into the proximity of the turbine outlet. The mechanism has guide means determining the trajectory of the head between a position in which the transmission member is simultaneously adjacent the spool and the drive shaft, and the position in which the yarn retained on the head is carried substantially to the level of the turbine outlet.

7 Claims, 8 Drawing Figures

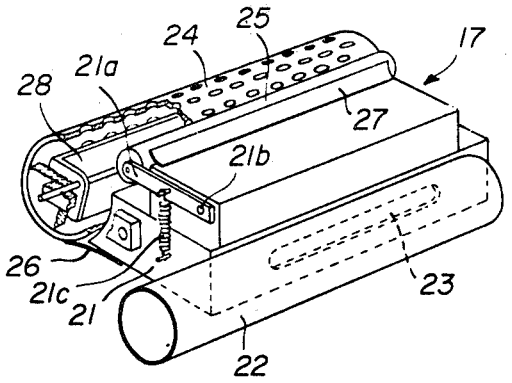
FIG. 5
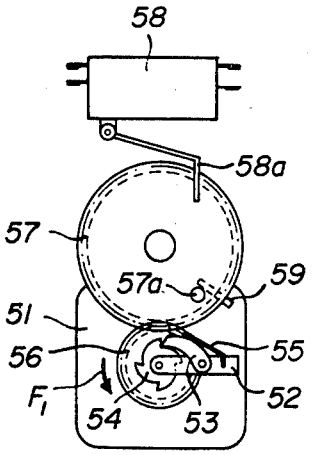
FIG. 6
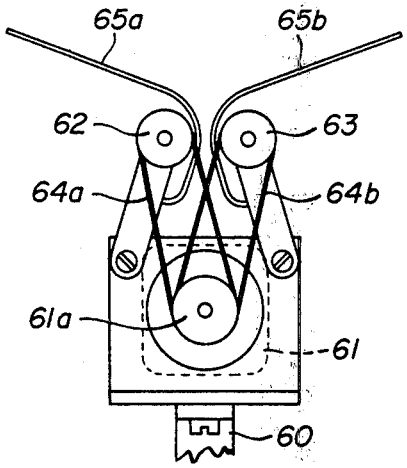
FIG. 7
FIG. 8
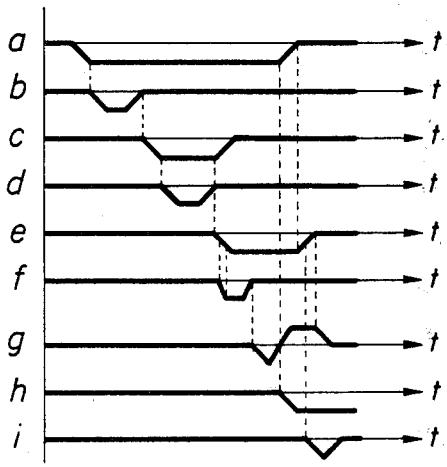

THREAD TYING DEVICE FOR SPINNING FRAME

Several operations are required in retying a yarn produced by an open-end spinning frame, in particular a turbine frame, namely cleaning the turbine rotor, locating the end of the broken yarn on the spool, returning the yarn to the turbine outlet, re-inserting the yarn into the turbine, starting the feed card for the turbine and re-inserting the yarn between the drive shaft of the frame and the press roller.

Because of the complexity and diversity of these operations, retying is generally carried out manually. However, automatic retying apparatus for operating on several frames are beginning to appear on the market.

Such apparatus has two significant drawbacks which constitute serious obstacles to their commercial progress. They are very expensive and their operational reliability is insufficient, with the result that they do not totally dispense with manual operation. Nevertheless, there is a chance of financial success for such apparatus, and the literature confirms this by the large number of proposed designs. However, any real progress with such automatic retying apparatus is only possible if its operational reliability is almost total and if the price of the apparatus offers sufficient financial advantage.

Among the aforesaid operations, two are particularly delicate, namely conveying the yarn to the turbine outlet and its re-insertion into the turbine such that the end of the yarn locates the fibers delivered by the card at the rotor periphery. The success and quality of the joint depend on this latter operation. In fact, as soon as the card delivers fibers into the turbine rotor, the yarn must be withdrawn again in order to prevent the formation of any thickening at the point of retying but the acceleration given to the yarn must not be too sudden either, otherwise there would be a risk of again breaking the yarn. It is precisely during this retying stage that the largest proportion of failures or poor quality joints occur, necessitating further cleaning of the yarn.

The object of the present invention is to at least partly remedy these drawbacks.

To this end, the invention provides a device for retying a yarn produced by an open-end spinning frame, in which the yarn is extracted through the outlet opening of a turbine by a drive shaft associated with a press roller, for winding on to a receiving spool driven by a second drive shaft, this device comprising a disengaging mechanism for the receiving spool, a head for locating the broken end of the yarn on the spool, a transfer mechanism to convey the yarn into the proximity of the turbine outlet, a member for cutting the yarn at a certain distance from the broken end, means for positioning this cut end in front of the turbine outlet, means for untwisting the portion of yarn on the spool adjacent to the cut end, and a mechanism for inserting a determined length of yarn into the turbine and then withdrawing this yarn once the joint has been made by accelerating it until it attains a speed substantially equal to the desired production speed.

This device is characterized in that the yarn locating head comprises a transmission member for transmitting the movement of said shaft to the disengaged spool, means for displacing the broken end of the yarn from the spool and means for retaining this yarn, and in that the head is kinematically rigid with the transfer mechanism, which comprises guide means for determining the trajectory of the head between a position in which the transmission member is simultaneously adjacent to the spool and the drive shaft, and a position in which the yarn retained on the head is conveyed at least substantially to the level of the outlet of the turbine, and drive means for moving the head along said trajectory. Positioning means are associated both with guide means for determining a trajectory between a laterally displaced position of the yarn, in which the yarn is held taut between the spool and the vicinity of the turbine outlet, and a position adjacent this outlet. A mechanism for drives the postioning means along the trajectory, the positioning means comprising a clamp and a mechanism for operating said clamp, the cutting member being located between the clamp and said yarn gripping means.

The accompanying drawing illustrates, diagrammatically and by way of example, one embodiment of the device for retying a yarn according to the present invention. In the drawing FIG. 1 is sectional view taken in to a plane transverse to the spinning frame.

FIG. 5 is a perspective cut-view of a further detail of FIGS. 1 and 2.

FIG. 6 is an enlarged elevation of a further detail of FIGS. 1 and 2.

FIG. 7 is a view from below of a further detail of FIGS. 1 and 2.

FIG. 8 is a functional diagram of the device.

Figure 1:
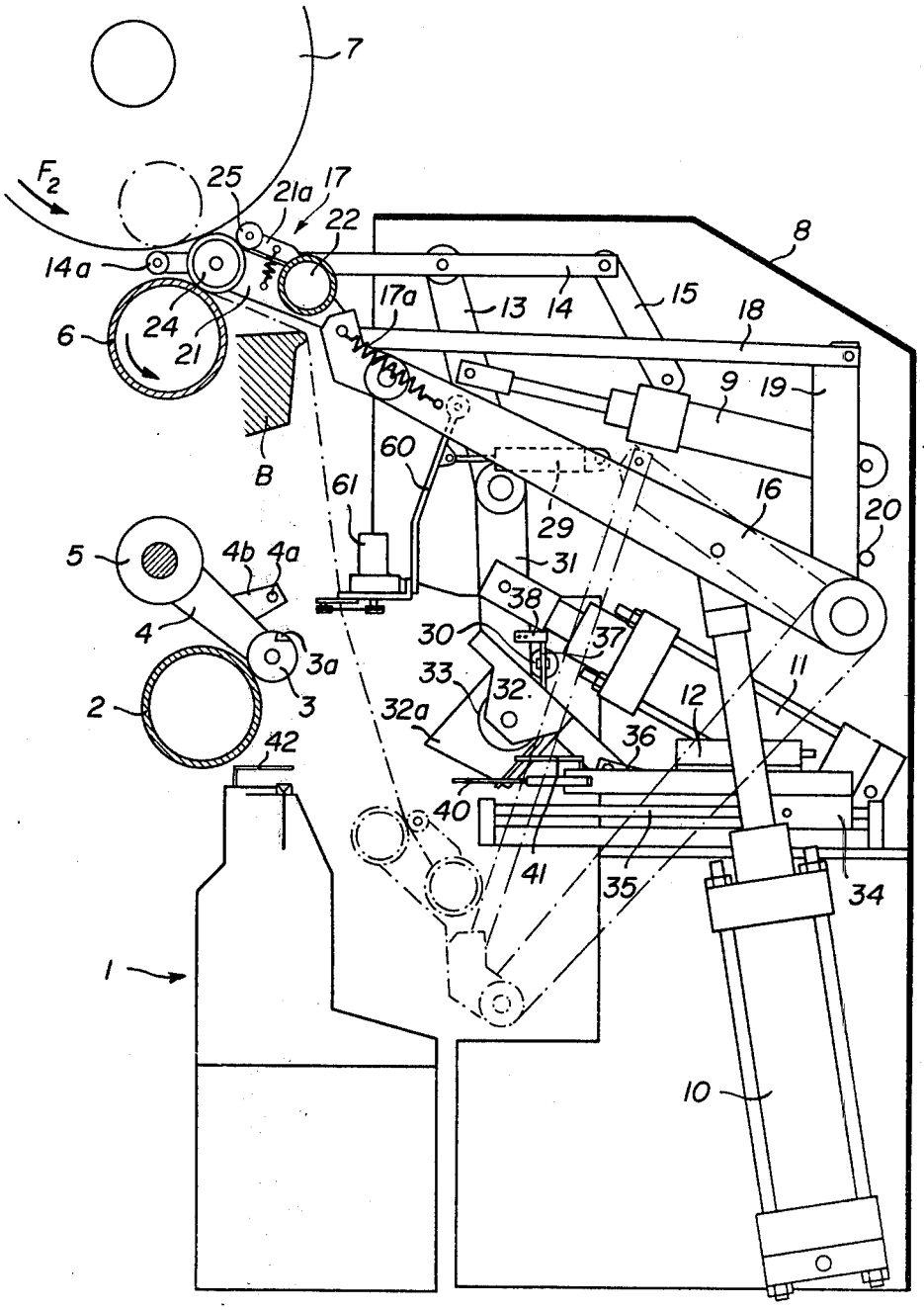

FIG. 1 is a cross-section through the spinning frame showing, in elevation, only those members necessary for understanding the present invention. These members are constituted by one of the turbine spinning heads 1 of the frame, an extraction shaft 2 for the yarn associated with a roller 3 rotatably mounted on the end of an arm 4 pivoting about a shaft 5 and biased by a spring (not shown) which tends to resiliently urge the roller 3 against the extraction shaft 2 which constitutes the drive shaft for the take-up spools, one of which (7) is visible in this figure. The dashed and dotted line shows the smallest diameter which the spool can have, this diameter corresponds practically to the tube of plastic material on which the yarn is initially wound. This spool is held resiliently between two arms (not shown) of a stirrup hinged about an axis parallel to the shaft 6 and the spool 7 is urged against the shaft 6 by a spring (not shown) acting on the stirrup.

The retying device is mounted in a casting 8 associated with a transfer system (not shown) designed to enable the device to operate with all the spinning heads of one or a number of neighboring frames. Independently of the type of cleaning mechanism for the turbine, which is neither described nor represented, this device comprises six jacks 9, 10, 12, 11, 29 and 30. The rod of the jack 9 is hinged to a lever 13 one end of which is pivotedally mounted on the casting 8, while its other end is hinged to an arm 14 designed to become disposed between the shaft 6 and the spool 7. For this purpose, the arm 14 is hinged to a second lever 15 substantially parallel to the lever 13 and designed to transmit a translatory movement to the arm 14 when the lever 13 is operated by the rod of the jack 9. The front end of the arm 14 comprises a roller 14*a*, for example of nylon, mounted to rotate freely about an axis transverse to the arm 14 and designed to facilitate the insertion of the arm between the spool 7 and shaft 6, and to facilitate rotation of the spool 7. The geometry of this mechanism is chosen such that when the arm 14 is in its forward position, the roller 14*a* does not touch the shaft 6.

The rod of the jack 10 is hinged to a lever 16, the free end of which is hinged to a yarn locating mechanism 17 shown in detail in FIG. 5. This mechanism is connected by a rod 18 to a second lever 19 pivotally mounted on the same axis as the lever 16 but independent of it.

A return spring 17*a* tends to pull the mechanism 17 towards the lever 16 by applying to the mechanism 17 a couple in a clockwise direction about the axis on which the mechanism is hinged to the lever 16. The angular movement of the lever 19 in the clockwise direction is limited by a stop 20.

The yarn-locating mechanism 17 illustrated in greater detail in FIG. 5 comprises an enclosure 21 connected to a suction source (not shown) by a conduit 22 communicating laterally with the enclosure 21 via an aperture 23. This enclosure is hinged to the end of the lever 16, and carries a first perforated roller 24 and a second roller 25 carried by two arms 21*a* hinged on both sides of the enclosure 21 about an axis 21*b*. The second roller 25 is pressed against the other roller 24 by a spring 21*c*. The two rollers 24 and 25 are parallel to the longitudinal axis of the shaft 6 and spool 7.

Gaskets 26 and 27 insure the tightness between the enclosure 21 and the respective rollers 24 and 25. The roller 24 is mounted concentrically to a fixed mask 28. The mask 28 is rigid with the enclosure 21, and its purpose is to block the perforations of the roller 24 situated as a sector of this roller lying between the gasket 26 and the line of contact between the roller 24 and spool 7 in passing through the line of contact between the roller 24 and shaft 6. When the enclosure 21 is put under suction by the suction source connected to the conduit 22, those perforations in the roller 24 situated in the sector between the line of contact between the rollers 24 and 25 and the gasket 26 create a suction inside the roller 24 which produces a suction through the perforations situated over the sector between the line of contact between the roller 24 and spool 7 and the line of contact between the rollers 24 and 25.

The rod of the jack 11 is hinged to a lever 31 rigid with a support 32 provided with a roller 33 mounted on the shaft of a reversing motor, which is not shown in FIGS. 1 and 2 because it is fixed behind the lateral plate 32*a* of the support 32, this motor and the mechanism associated therewith being shown in FIG. 6 and described hereinafter. As can be seen from FIG. 2, the upper edge of the lateral plate 32*a* is designed to disengage the roller 3 from the yarn extraction shaft 2 by lifting the arm 4 via a pin 4*a* extending laterally from an appendage 4*b* of the arm 4.

An arm 37 is pivotally mounted about an axis extending perpendicularly below the lever 31. This arm, disposed normally behind the yarn, is rotated by the jack 30 so that it pushes the yarn towards the front edge of the roller 3 and is urged against the rod of said jack by a spring 38. The purpose of the arm 37 is to make the yarn engage with a notch 3*a* provided in one of the edges of the roller 3, its well known purpose being to re-insert the yarn between the roller 3 and shaft 2.

The support 32 is connected to a slide 34 mounted on a slideway 35 rigid with the casting 8 by a connection bar 36 hinged at its two ends to the frame 32 and slide 34 respectively.

Figure 3:
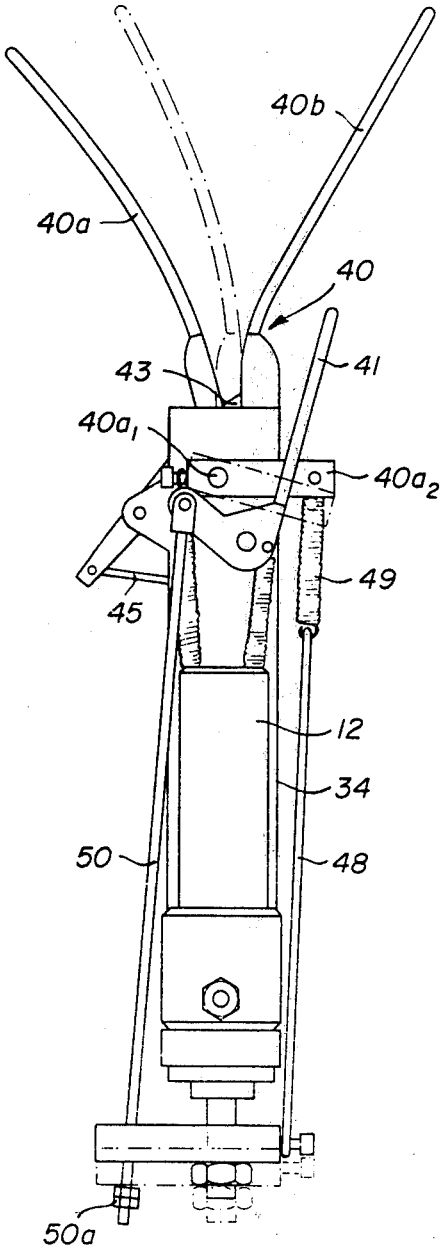
FIG. 3 is a view from above of a detail of FIGS. 1 and 2.
Figure 4:
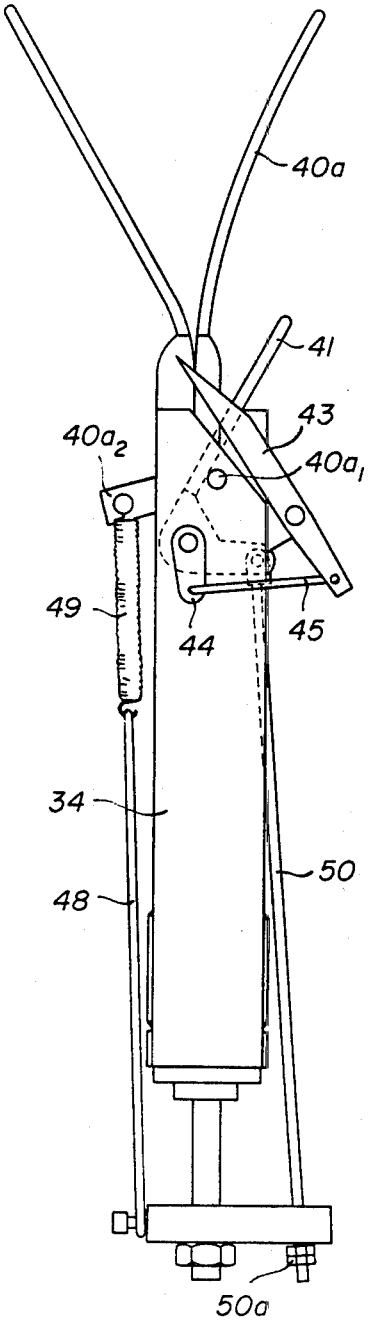
FIG. 4 is a view from below of the detail shown in FIG. 3.

The slide 34 carries the jack 12, the rod of which points away from the spinning frame. The rod of said jack controls directly and indirectly three members (FIGS. 3 and 4) constituted by a jaw 40*a* of a yarn clamp 40, pivotally mounted about a shaft $40a_1$, a lever 41 pivoted about a vertical axis and designed to displace the yarn from a yarn breakage detection arm 42 (FIGS. 1 and 2) rigid with the spinning head 1, and a knife 43 pivotally mounted about a vertical axis and disposed below the clamp 40 and adjacent thereto (FIG. 4). This knife is connected by a rod 45 to an arm 44 keyed on to the pin of the lever 41.

The mobile jaw 40*a* is connected to the rod of the jack 12 by a rod 48, a spring 49 designed to absorb the stroke movement of the rod of the jack 12 after the jaws 40*a* and 40*b* close, and a lever $40a_2$ keyed on to the shaft $40a_1$. A second rod 50 connects the rod of the jack 12 to the lever 41. The rod 50 comprises an abutment 50*a* designed to delay the operation of the lever 41 with respect to the closing of the yarn clamp 40.

Figure 2:
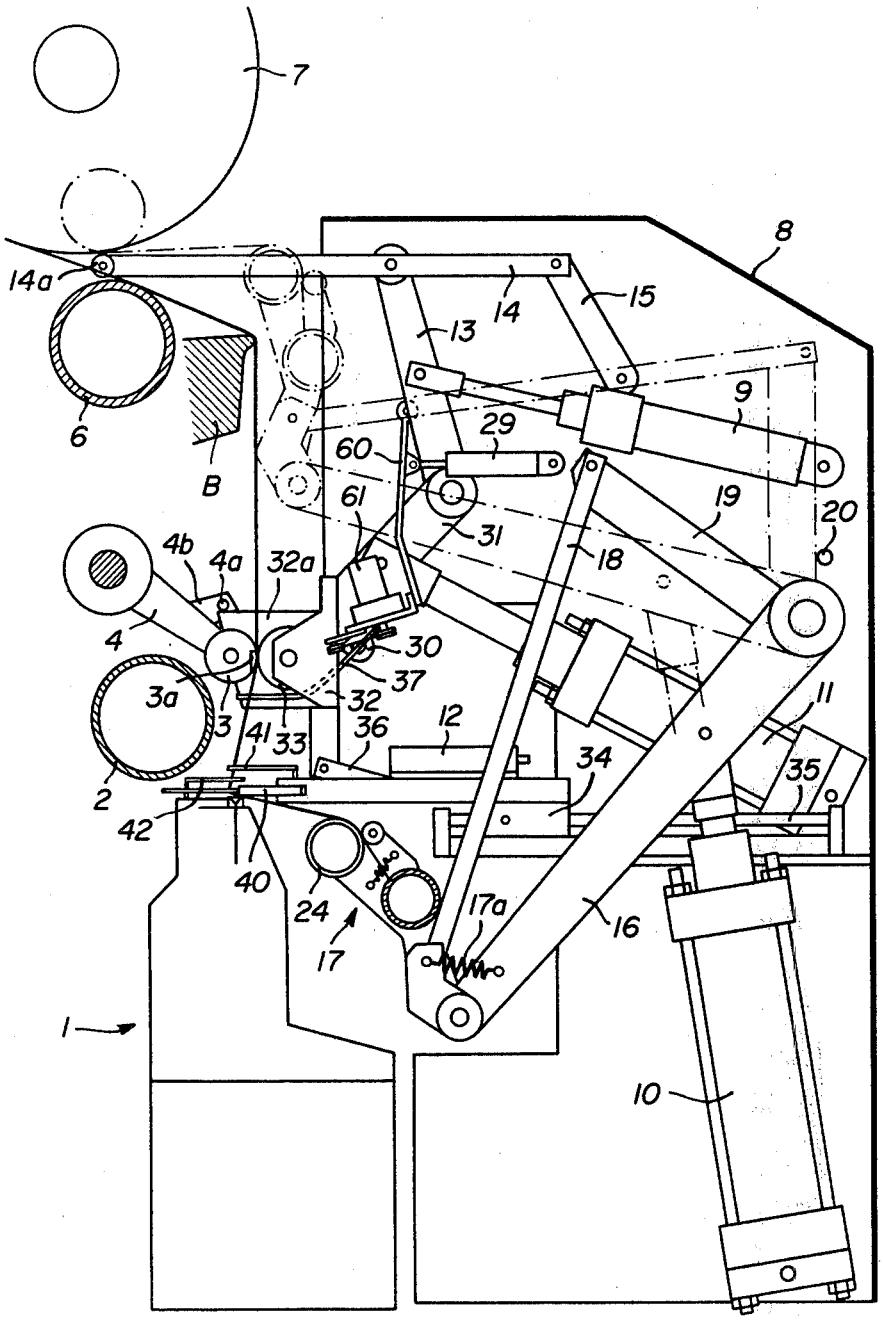
FIG. 2 is a view similar to that of FIG. 1, showing the members in order characteristic positions of a further stage of the tying process.

FIG. 6 illustrates in detail the control mechanism for reversibly driving the roller 33 (FIG. 1 and 2). This mechanism comprises a motor 51, with the roller 33 keyed on to its shaft. An arm 52 rigid with said shaft carries a pawl 53 pressed by a spring 54 against the tooth of a ratchet wheel 54 idly mounted on the shaft of the motor 51. The ratchet wheel 54 is rigid with the second wheel 56 which is coaxial thereto and engages with a wheel 57 controlling a change-over switch 58 for reversing the direction of rotation of the motor 51. The control wheel carries a prong 57*a*, in the trajectory of which there is a fixed stop 59 and an operating lever 58*a* for the change-over switch 58.

When the mechanism is at rest, the prong 57*a* rests against the stop 59. The motor 51 is started from a control station (not shown) the functions of which are illustrated by the diagram of FIG. 8. The motor drives the wheel 56 in the direction of the arrow $F_1$ by way of the pawl 53. This wheel 56 engages with the wheel 57, and the prong 58*a* leaves the stop 59. When the prong 57*a* operates the lever 58*a*, the direction of rotation of the motor 51 is reversed. The wheel 56 is driven in the reverse direction. As the shape of the teeth on the ratchet wheel 54 are such that in this direction the pawl 53 could disengage, the spring 55 is chosen such as to exert a sufficient pressure on the pawl to prevent it disengaging until the prong 57*a* returns to the stop 59. At this moment the wheels 56 and 57 are locked, but the arm 52 and pawl 53 can continue to turn.

The advantage of this mechanism lies in the fact that it is designed not only to insert a limited quantity of yarn into the spinning head 1, but is also capable, in the other direction of rotation, of withdrawing an unlimited length of yarn. The dissymmetry of these two functions is an important advantage in relation to the mechansims generally used in other retying devices. In this respect it is in fact advantageous, after the retying, to be able to extract a long length of yarn from the turbine so that the yarn attains its normal production speed with a given acceleration before passing between the roller 3 and extraction shaft 2.

Finally, the jack 29 rotates an arm 60 (FIGS. 1 and 2) hinged on the casting 8. The free end of said arm 60 carries a mechanism illustrated in greater detail in FIG. 7 and comprising a motor 61, the shaft of which carries a roller 61*a* connected to two other rollers 62 and 63 by belts 64a, 64b of synthetic rubber. These rollers are disposed at the vertices of a triangle so that one of the arms of one of the belts cuts one of the arms of the other belt, these arms moving in opposite directions when the roller 61a drives them. Two guides 65a and 65b help to insert the yarn between the belts 64a and 64b when the arm 60 is raised by the jack 29 (FIG. 1). The yarn is then gripped at the intersection of the two crossed arms of the belts 64a and 64b. When the motor 61 is started, it causes the yarn gripped between the belts 64a, 64b to rotate about itself. The direction of this rotation is chosen to give an over-twist to that portion of the yarn lying between the belts 64a, 64b and spool 7, and to untwist the portion of yarn lying below these belts.

The functional diagram of FIG. 8 allows the chronological sequence of the different functions necessary in the actual retying operation to be described, the turbine cleaning operation which precedes the retying being totally excluded from the scope of the present invention.

At a first time, illustrated by the beginning of the function a of the diagram of FIG. 8, the casing 8 is placed opposite the desired spinning head 1 and the source of pressurized supply fluid (not shown) for the described device is fed to the jack 9. The rod of said jack is thrust out of the cylinder. The lever 13 associated with the jack 9 swivels about its pivoting axis to drive the arm 14, which by its own movement drives the second lever 15 to convert the movement of the arm into a translatory movement along its longitudinal axis. The roller 14a encounters the spool 7 and lifts it. As the roller 14 is separated from the shaft 6, the spool is immobilized. The arm 14 is in a plane adjacent to that side of the spool situated to the rear relative to the plane of FIGS. 1 and 2. The roller 14a extends laterally on that face of the arm 14 facing the front.

The beginning of function b (FIG. 8) follows immediately the lifting of spool 7. This function corresponds to the operation of the jack 10, the rod of which moves the lever 16 from the position shown by the solid line in FIG. 2 to the position shown in FIG. 1, by passing through the intermediate position shown by a dashed and dotted line in FIG. 2.

Because of the system consisting of the two levers 16 and 19 and the connecting rod 18, the yarn locating mechanism 17 hinged to the end of the lever 16 makes two successive partly combined angular movements, one about the pivoting axis of the lever 16 on the casing 8, and the other about the axis of hinging of the mechanism 17 at the end of the layer 16. The first part of the movement is constituted by the rotation of the lever 16 about its pivoting axis. Because of the return spring 17a, the mechanism 17 then preserves a fixed position relative to the lever 16 until the movement in which the second lever 19 encounters the stop 20. This position is that shown by the dashed and dotted line in FIG. 2. After this movement and until the position shown by the solid line in FIG. 1, the trapezium formed by the lever 16, lever 19, rod 18 and that portion of the mechanism 17 situated between the two hinges of the lever 16 and rod 18 respectively deforms, inducing a complex movement composed of a rotation of the lever 16 in a clockwise direction simultaneously with a movement in the opposite direction of the mechanism 17 about its axis of hinging to the lever 16.

The purpose of this combined movement of the mechanism 17 is to bypass the obstacle formed by the part B of the framework of the spinning frame in order to bring the roller 24 into simultaneous contact with the spool 7 and shaft 6. In this manner, the shaft 6 drives the roller 24 and the spool 7. Since the rotation of the shaft 6 is then indirectly communicated to the spool 7 via the roller 24 which acts as a reversing member, the spool turns in the direction $F_2$ for unwinding the yarn. As the enclosure 21 is put under suction by a suction source (not shown) connected to the conduit 22, air is drawn through those perforations of the roller 24 situated outside the enclosure 21 and outside the sector shut off by the fixed mask 28 (FIG. 5). When that part of the broken yarn wound on the spool 7 passes over the roller 24, it is retained by suction against the surface of this roller which, on turning, drives it into the enclosure 21 by passing it through the clamp formed by the line of contact of the rollers 24 and 25.

At the end of a predetermined time which corresponds at least to one complete rotation of the spool 7 at its maximum diameter, the jack 10 withdraws its rod so that the lever 16 and the mechanism 17 return to the position shown by the solid line in FIG. 2 or by the dashed and dotted line in FIG. 1, by passing through the intermediate position shown by the dashed and dotted line in FIG. 2.

The yarn is then located, seized and returned to the proximity of the spinning head 1 by the same mechanism due to the fact that the rollers 24 and 25 enable the yarn to be recovered on the spool 7 and then retained because of the deformable geometry of the trapezium controlling the combined movement of the mechanism 17 which enables obstacles, and in particular the part B of the framework of the spinning frame, to be bypassed. When the cycle of function b (FIG. 8) is ended, i.e. when the lever 16 has returned to its initial position, the jack 29 begins to operate (function c, FIG. 8), the effect of which is to raise the arm 60 (FIG. 1). The guides 65a and 65b (FIG. 7) conduct the yarn, held taut between the spool 7 and rollers 24, 25 as shown by the dashed and dotted line in FIG. 1, between the belts 64a and 64b which pinch the yarn.

The motor 61 is started (function d, FIG. 8). The duration of its rotation is adjusted so as to introduce a determined degree of over-twist and simultaneous untwisting, according to the particular nature of each type of yarn, on one side and the other of the point at which the yarn is pinched between the belts 64a and 64b.

Before function d terminates, the rod of the jack 11 begins to operate (function e), the effect of which is to move the support 32 of the roller 33 from the position shown in FIG. 1 to that shown in FIG. 2. At the end of the stroke, the lateral plate 32a of the framework 32 raises the arm 4 to separate the roller 3 from the shaft 2. The yarn is then pinched between the rollers 3 and 33, which do not turn. Function d then function c cease and the arm 60 is conveyed backwards by the jack 29.

The movement of the lever 31 is accompanied by the movement of the slide 34, driven by the connecting rod 36. The fork formed from two extensions of the jaws 40a and 40b of the yarn clamp 40 (FIGS. 3 and 4) guides the yarn passing from the spool 7 (FIG. 2) to the rollers 24 and 25 via the framework B and rollers 3 and 33, between the jaws of the clamp 40. The knife 43 (FIGS. 3 and 4) limits the penetration of the yarn between these jaws. At the end of the forward stroke of the slide 34, the yarn is retained in the clamp 40 just above the outlet channel of the spinning head 1.

As shown in FIG. 8, function f begins during the forward movement of the slide 34 (function c). This function f is controlled by the rod of the jack 12. During its stroke, this jack produces three distinct functions, namely, in chronological order, closing the yarn clamp 40, rocking the lever 41 and rocking the knife 43. The yarn clamp 40 closes when the yarn, held taut between the part B of the framework and the clamp formed by the rollers 24 and 25, encounters the knife 43 disposed across the yarn clamp. As soon as the yarn is pinched, the rod of the jack 12 (FIGS. 3 and 4) encounters the stop 50*a* disposed along the rod 50, and rocks the lever 41 in counterclockwise direction, seen from above. The effect of this rocking is to displace the yarn before the yarn clamp arrives above the outlet channel of the spinning head 1. The yarn thus displaced is kept out of range of the breakage detector 42 of the spinning head 1. At the same time, this displacement of the yarn increases the length of the yarn by unwinding this additional length from the spool 7 which always rests on the roller 14*a*.

During the rocking of the lever 41, the arm 44, keyed on to the pivoting axis of this lever, rocks the knife 43 about its pivoting axis by means of the rod 45. The knife 43 cuts the yarn on a level with the bottom of the yarn clamp 40. As shown in FIG. 8, function f commences after function c, and terminates before the end of the forward movement of the slide 34. Consequently, when the knife 43 has cut the yarn, the cut end is positioned just above the turbine outlet. In fact, the position of the yarn in the yarn clamp having been well defined by the cutting blade 43 placed across the yarn clamp, it is easy to make the cut end of the yarn coincide with the outlet of the channel in the spinning head 1 at the end of the foward stroke of the slide 34. Moreover, as the yarn has previously been untwisted in its lower part, and is then pinched between the rollers 33 and 3, this degree of untwisting remains in the lower part while the other part of the yarn preserves its over-twist.

As the slide 34 is immobile, the jack 12 returns its rod backwards as indicated by the end of function f of the diagram of FIG. 8. The three functions controlled by this jack are then executed in a reversed chronological order. The knife 43 rocks in the opposite direction until it strikes against the slide 34. The lever 41 also returns backwards. However, since the yarn is pinched between the rollers 3 and 33, the untwisted part of the yarn extends. When the clamp opens at the end of the stroke of the rod of the jack 12, the untwisted end of the yarn situated just at the outlet of the channel in the head 1 is sucked into this channel by the suction in the turbine, to take up the slackness in the yarn without the tension thus exerted being sufficient to rotate the yarn cutter 42.

Function g of FIG. 8 represents the running of the motor driving the roller 33. The direction of rotation of this motor is then chosen to unwind a certain length of yarn from the spool 7 in order to convey the untwisted end of the yarn into the turbine. During the descending movement of the yarn between the rollers 3 and 33, the yarn portion previously subjected to over-twist passes below these rollers so that the previously untwisted part again becomes twisted.

When this length of yarn has been supplied, the direction of rotation of the motor driving the roller 33 is reversed. Tension is produced on the yarn from the moment in which the motor for the roller 33 slows down because of the centrifugal force to which the end of the yarn in the turbine is subjected. The effect of this tension is to rotate the yarn cutter 42 which couples the card of the spinning head 1 to the drive mechanism for the spinning frame as shown by function h. Since this coupling system operated by the yarn cutter is provided in all turbine spinning frames, and is thus known and does not form part of the present invention, it has neither been represented nor described.

The fibers fed by the card into the turbine then encounter the end of the yarn, on to which they twist to make the joint. During this time, the speed of the roller 33 passes through zero before reversing (FIG. 8*g*). Simultaneously with the commencement of acceleration of the roller 33 in the reverse direction of rotation, i.e. in the direction in which the yarn is extracted from the spinning head 1, the jack 9 moves the arm 14 backwards (end of function a of FIG. 8) such that the spool 7 takes up the yarn as it is produced. The drive motor for the roller 33 accelerates until the speed with which the yarn is driven is equal to the speed of extraction of the shaft 2. At this moment, the jack 11 (end of function e of FIG. 8) moves the lever 31 and support 32 backwards.

During this backward movement, the jack 30 rotates the arm 37, as shown by function i. The effect of this rotation of the arm is to convey the yarn towards one of the edges of the roller 3 comprising the notch 3*a*, as in the case of all press rollers used on such spinning frames, the purpose of which is to seize the yarn during its passage, in order to convey it between the press roller 3 and the extraction shaft 2 of the spinning frame.

The retying device has then terminated its operation and the yarn is again produced normally. It can be conveyed by the conveying system (not shown) associated with it, to a position opposite another spinning head of the same frame or of another frame.

The originality of the arrangement of the levers 16 and 19 connected by the rod 18 and the complex movement which can be derived from this arrangement have already been emphasized. The mechanism associated with the jack 12 and enabling this jack to produce three different and successive functions is equally of great advantage in that it too enables the rying device to be simplified. Note should also be taken of the advantage resulting from the fact that the yarn clamp 40 positions the cut end of the yarn at the outlet of the spinning head. This position constitutes an important guarantee in terms of operational reliability. In this respect, as the end of the yarn is positioned by the yarn clamp at the outlet of the spinning head and the yarn is made slack on opening the yarn clamp by the lever 41 returning to its rest position, the end of the yarn becomes seized in the outlet channel of the head 1 on opening the clamp, because of the suction in this channel produced by the rotation of the turbine. As the yarn has a certain amount of slackness, this slackness is taken up in the outlet channel of the head, to guarantee with almost total reliability that the yarn becomes engaged in the channel.

A further important aid to the reliability of the joint is the use of a reversing notor for driving the roller 33. When the direction of rotation of this motor is reversed, the yarn firstly decelerates, then stops and starts again in the reverse direction, accelerating to its normal production speed. Because of this, the yarn is not subjected to abrupt changes which frequently compromise the success of the joint. The time necessary for the yarn speed to pass from zero to the production speed of the frame is not limited, and the motor speed may be adjusted as required, using a resistance. Moreover, independently of the speed of rotation of the motor, the time needed to reverse the direction of rotation may be adjusted by varying the mass of the flywheel rigid with the motor drive shaft, and this flywheel may be constituted by the roller 33 itself. Consequently, a simple adjustment is sufficient to adapt the rejoining device to frames having different production speeds.

The mechanism operated by the motor 61 for untwisting that part of the yarn to be joined and momentarily retwisting that portion of the yarn situated on the take-up spool side is an extremely advantageous element of the device. It untwists the part to be retied, so ensuring better retying and suppressing the natural tendency of the yarn to turn about itself when the clamp 40 is opened. Furthermore, the over-twist given to the other portion of the yarn is used to retwist the previously untwisted portion as the yarn descends between the rollers 3 and 33. There is therefore no loss of twist at any moment along the yarn, and instead this twist is transferred instantaneously from one portion of the yarn to another.

Finally, the described device comprises a minimum number of members, and essentially jacks and levers. It is very simple and is designed such that any risk of failure and the maintanance required are practically negligible, so that the purchase and use of the device allow substantial progress to be obtained relative to manual retying and to other known automatic rejoining devices.

I claim:

1. In a device for retying a yarn produced by an open-and spinning frame, in which the yarn is extracted through the outlet opening of a turbine by a drive shaft associated with a press roller, for winding on to a receiving spool driven by a second drive shaft, the device comprising a disengaging mechanism for the receiving spool, a head for locating the broken end of the yarn of the spool, a transfer mechanism to convey the yarn into the proximity of the turbine outlet, a member for cuting the yarn at a certain distance from the broken end, means for positioning this cut end in front of the turbine outlet, means for untwisting the portion of yarn on the spool adjacent to the cut end, and a mechanism longitudinally entraining the yarn and including means for inserting a determined length of yarn into the turbine and means for then withdrawing this yarn once the joint has been made by accelerating the yarn until the yarn attains a speed substantially equal to the required production speed, the improvement wherein said yarn locating head comprises a transmission member for transmitting the movement of said shaft to the disengaged spool, means for displacing the broken end of the yarn from said said spool and means for retaining this yarn, and in that said head is kinematically rigid with said transfer mechanism, which comprises guide means for determining the trajectory of said head between a position in which said transmission member is simultaneously adjacent to the spool and said drive shaft, and a position in which the yarn retained on said head is conveyed at least substantially to the level of the outlet of said turbine, and drive means for moving said head along said trajectory, said positioning means being associated both with guide means for determining a trajectory between a laterally displaced position of the yarn, in which the yarn is held taut between the spool and the vicinity of the turbine outlet, and a position adjacent to this outlet, and with a mechanism for driving them along said trajectory, said positioning means comprising a clamp and a mechanism for operating the clamp, said cutting member being located between said clamp and said yarn gripping means.

2. Retying device as claimed in claim 1, characterized in that said transfer mechanism comprises a transfer lever hinged about an axis parallel to that of said drive shaft, said lever being mobile between two angular limiting positions, and said head is hinged to the free end of said lever about an axis parallel to the hinging axis of said lever, said head being able to occupy two angular limiting positions relative to the lever, and a resilient return member which constantly tends to urge said head into said angular positions, and in that said head is connected to a second lever coaxial to the transfer lever and angularly free relative thereto, the extremity of this second layer being connected by a rod to a point on said head spaced apart from its axis of hinging to the transfer lever, and in that a fixed stop is disposed in the trajectory of said second lever to induce a relative angular movement between the second lever and the transfer lever, such that said rod conveys said head into the second of said angular positions against the action of said return member.

3. Retying device as claimed in claim 1, characterized in that said head comprises an enclosure with an inlet aperture designed for connection to a suction source and an outlet aperture adjacent to said transmission member, the enclosure being constituted by a tubular cylinder closed at its ends, its cylindrical wall being traversed by a plurality of equally distributed perforations, a portion of the surface of said cylinder being adjacent to a fixed mask, the cross-section of which is in the form of a cylindrical sector positioned in such a manner as to unblock the perforations of the cylinder only when they pass into the peripheral region in which the cylinder is designed to come into contact with said receiving spool, a roller rotatably mounted about an axis parallel to that of said cylinder being urged resiliently thereagainst so as to form with said cylinder a grip for the yarn separated from the spool by the air sucked through said perforations in the cylinder.

4. Retying device as claimed in claim 1, characterized in that said means for untwisting the portion of yarn adjacent to the cut extremity are associated both with guide means for determining a trajectory between a laterally displaced position of the yarn, in which the yarn is held taut between the spool and the vicinity of the turbine outlet, and a position adjacent to said yarn in that portion of the yarn situated between said positioning means and the spool, and with a mechanism for driving them along said trajectory, said means for untwisting said portion of yarn comprising two adjacent overlying belt arms, these arms forming a contained acute angle in a plane substantially perpendicular to the yarn and opening in the direction of said yarn, so that the yarn becomes pinched at the intersection of said belts when they are conveyed into said position adjacent to the yarn, and means for driving the belt arms in opposite directions to each other so as to create on the yarn a couple in a direction which is chosen to cause that portion of yarn lying between the intersection of said belts and said positioning means to become untwisted, and that portion of yarn lying between said intersection and the receiving spool to become overtwisted.

5. Retying device as claimed in claim 1 for a spinning frame in which the yarn is extracted from the turbine by a drive shaft associated with a press roller, characterized in that said mechanism for inserting a determined length of yarn into the turbine and then withdrawing said yarn comprises a drive roller associated both with guide means for determining a trajectory between a laterally displaced position of the yarn, in which the yarn is held taut between the spool and the vicinity of the turbine outlet, and a position in which said drive roller presses the yarn against said press roller, and with a mechanism for driving the drive roller along said trajectory, said drive roller being associated also with means for displacing the press roller from its drive shaft, and in that said drive roller is rotated by a drive mechanism the direction of rotation of which is reversible and which comprises a device for reversing its running direction, a first wheel provided with a prong for operating said reversing device and a stop for the prong, and a second wheel, kinematically rigid with the first wheel, and adjusted to rub on a drive shaft, said second wheel being connected to said shaft by a unidirectional ratchet mechanism so as to be driven by this mechanism in one direction of rotation, and by friction in the other direction of rotation.

6. Retying device as claimed in claim 5, characterized in that said positioning means and said drive roller are connected kinematically to each other and therefore comprise a common drive mechanism for driving them along their respective trajectories.

7. Retying device as claimed in claim 5, characterized in that an additional lever is disposed between said clamp and said drive roller, and is kinematically rigid with the drive mechanism for said clamp, said lever being hinged to move in a plane transverse to the yarn when held taut between the spool and the vicinity of the turbine oulet, and being connected to a mechanism for moving it between two determined angular positions, namely one in which it is displaced from said taut yarn while the clamp is in its position adjacent to the turbine outlet, and the other in which it laterally drags a portion of yarn held taut by said clamp and gripped between said drive roller in contact with said press roller.

* * * * *